United States Patent [19]

Rekow

[11] 4,356,952

[45] Nov. 2, 1982

[54] STACKABLE TRAY WITH CORNER SUPPORTS

[75] Inventor: Vernon C. Rekow, St. Paul, Minn.

[73] Assignee: Champion International Corporation, Stamford, Conn.

[21] Appl. No.: 271,696

[22] Filed: Jun. 8, 1981

[51] Int. Cl.[3] ..... B65D 5/44

[52] U.S. Cl. ..... 229/34 R; 229/32

[58] Field of Search ..... 229/34 R, 34 B, 31 FS, 229/32

[56] References Cited

U.S. PATENT DOCUMENTS

| | | | |
|---|---|---|---|
| 2,525,268 | 10/1950 | Napier | 229/34 R |
| 2,926,831 | 3/1960 | Strange | 229/32 |
| 3,410,475 | 11/1968 | Wagner | 229/34 R |
| 3,412,921 | 11/1968 | Rekow | 229/32 |
| 3,572,577 | 3/1971 | Dorfman | 229/32 |
| 3,871,570 | 3/1975 | Garmon | 229/32 |
| 3,917,156 | 11/1975 | Baudet | 229/32 |

FOREIGN PATENT DOCUMENTS

| | | | |
|---|---|---|---|
| 2261943 | 9/1975 | France | 229/32 |

*Primary Examiner*—Herbert F. Ross
*Attorney, Agent, or Firm*—Evelyn M. Sommer

[57] ABSTRACT

A one-piece tray is provided with corner ledges that serve as corner reinforcement bases when the trays are stacked one upon another. The side panels of the tray are provided with retaining lips extending from their top edges. The end panels are provided with tongues extending from the folded top edges thereof. The retaining lips and tongues serve to prevent lateral movement among the trays when stacked.

6 Claims, 10 Drawing Figures

Fig. 1.
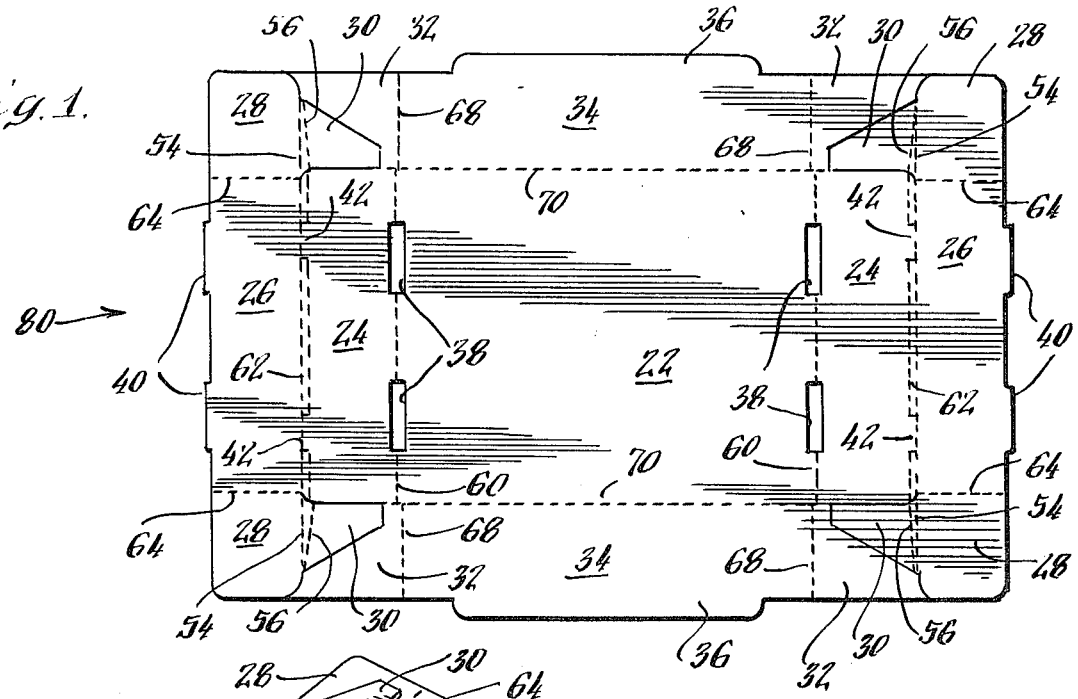
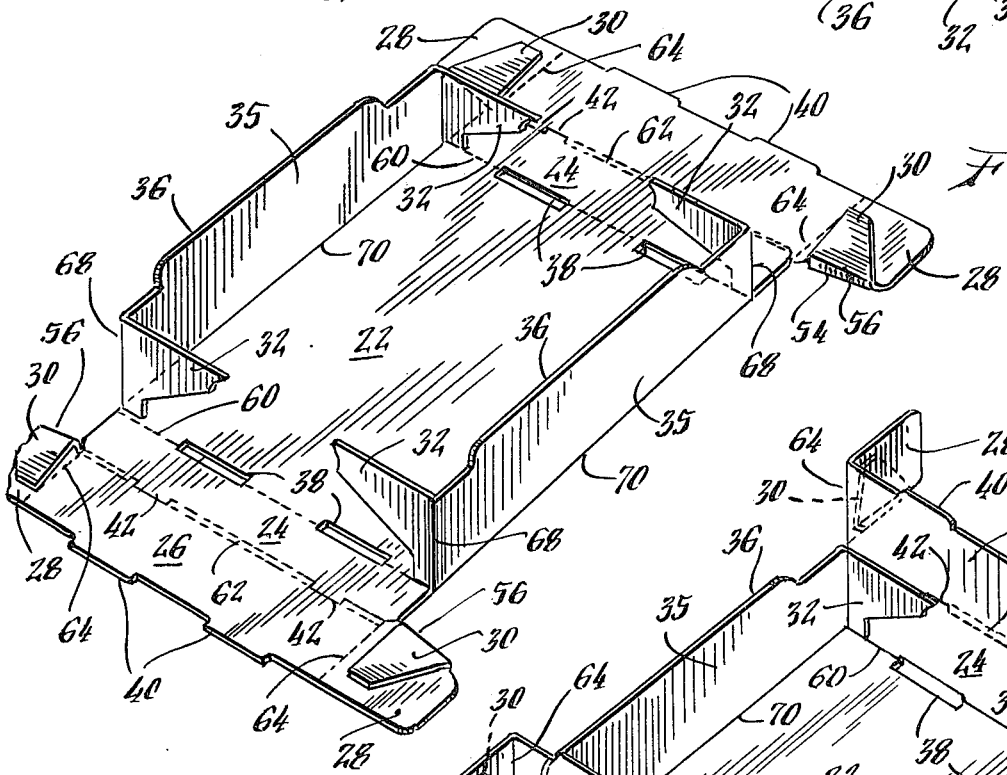
Fig. 2.
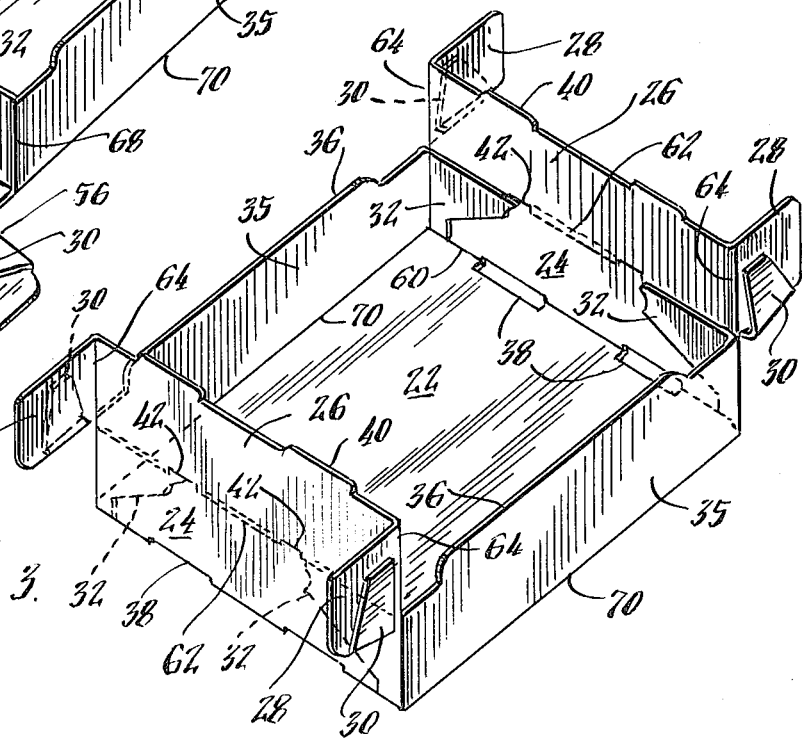
Fig. 3.

Fig. 8.
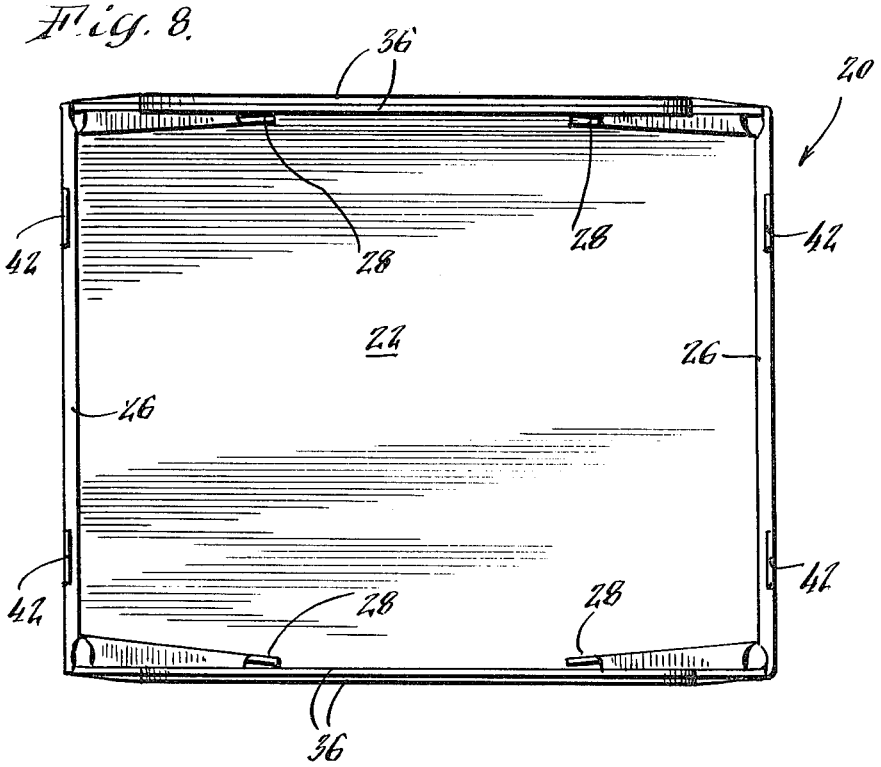
Fig. 11.
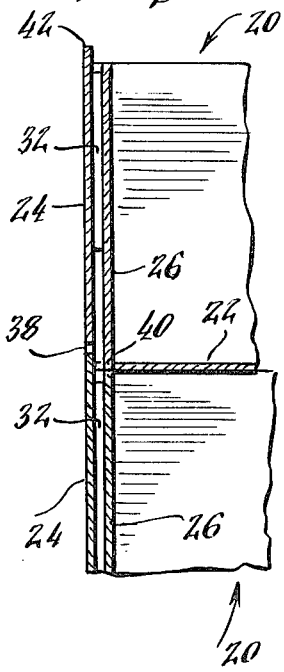
Fig. 9.
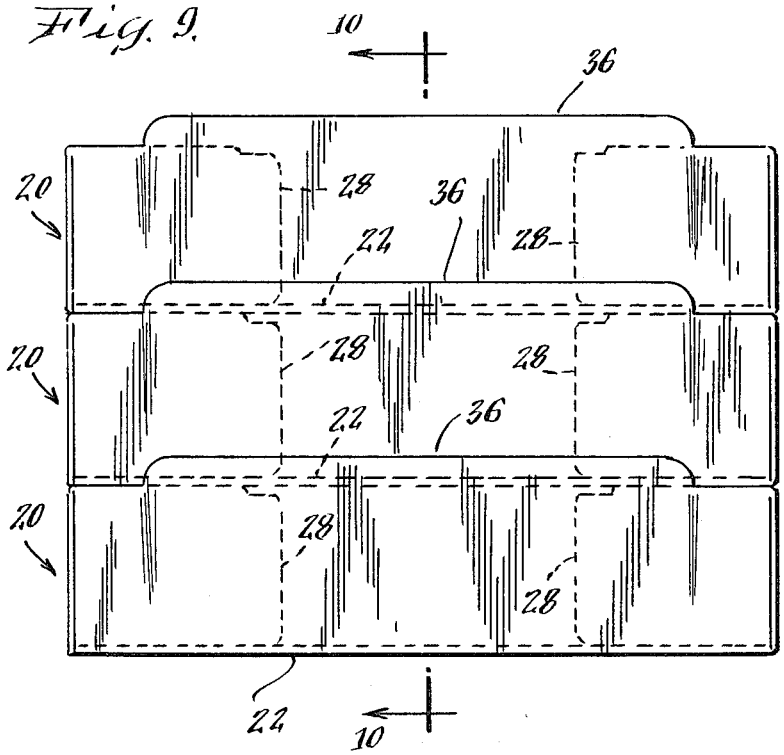
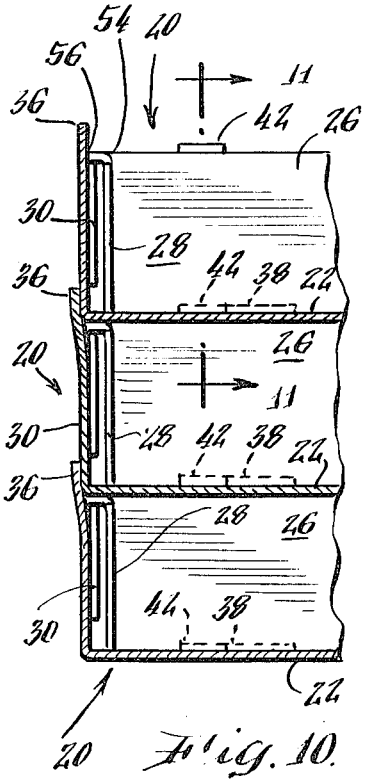
Fig. 10.

STACKABLE TRAY WITH CORNER SUPPORTS

BACKGROUND OF THE INVENTION

This invention relates to a stackable tray and, more particularly, to a tray having integral corner ledges which serve as corner reinforcement bases when the trays are stacked one on top of another.

In the past, stackable trays have been provided which when stacked in a fully loaded condition were subject to collapse. Additionally, such trays were prone to lateral shifting with respect to one another when stacked. Such lateral shifting was apt to progress beyond the point of equilibrium, at which time one or more of the stacked trays would topple over and spill or damage its contents.

It would be advantageous to provide a tray having enough strength to support one or more fully loaded trays stacked on top of it. The tray should incorporate features to prevent the lateral shifting of other trays stacked on top of it.

This invention relates to such a tray.

SUMMARY OF THE INVENTION

The tray of the present invention is provided with a bottom wall for supporting articles. A pair of opposed side walls and a pair of opposed end walls connecting the side walls are foldably connected to the bottom wall.

The end wall panels are constructed by folding two hingedly interconnected rectangular panels back to back. The innermost of said panels is provided with tabs which are inserted in notches in the bottom wall of the tray to maintain the tray in an erect, rectangular configuration. The side wall panels have flaps hingedly connected to the edges thereof which flaps are retained between the back-to-back panels forming the end walls.

The innermost of each end wall panel also has a pair of corner ledge wings (or end panel extensions) hingedly connected to its opposed edges. Each corner ledge wing includes a flap member which when folded back to back with its respective corner ledge wing forms a ledge which rests adjacent to its corresponding side wall. Thus, inside each corner of the tray and adjacent to the side wall which forms the corner, there exists a ledge, or shelf, which serves to support another similar tray stacked on top of the first tray.

The flap members which are connected to the corner ledge wings may each have two non-parallel crease lines which provide a tapered top edge to the corner ledge formed when said flap is folded over in back-to-back relation with its corner ledge wing. This construction results in corner ledge wings which exhibit a spring force directed inwardly toward the center of the tray. Thus, articles completely filling the tray are somewhat cushioned as a result of light pressure from the corner ledge wings.

The side walls of the tray have retaining lips extending from their top edges. These lips prevent lateral movement of stacked trays among one another. Tongue members projecting from the top folded edge of the end panels serve a similar purpose.

BRIEF DESCRIPTION OF THE DRAWINGS

Further objects and advantages of the invention will become apparent from the following description and claims, and from the accompanying drawings, wherein;

FIG. 1 is a plan view of a blank for forming the stackable tray of the present invention;

FIGS. 2 through 4 are perspective views illustrating the folding of the blank of FIG. 1 to form the tray of the present invention;

FIG. 8 is a top view of the tray shown in FIG. 4;

FIG. 9 is a cross-sectional view showing three trays stacked one on top of the other;

FIG. 10 is a partial cross-sectional view taken substantially along the plane indicated by line 10—10 of FIG. 9;

FIG. 11 is an enlarged cross-sectional view taken substantially along the plane indicated by line 11—11 of FIG. 10.

DETAILED DESCRIPTION OF THE PREFERRED EMBODIMENT

Figure 4:
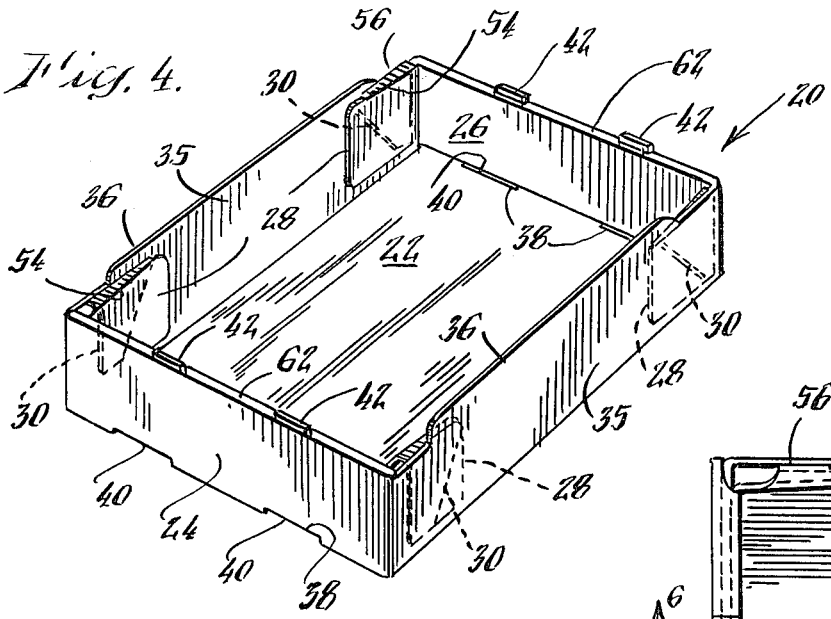

Referring now to the drawings in detail, wherein like numerals indicate like elements throughout the several views, the present invention comprises a substantially rectangular stackable tray 20 having end walls 50 and side walls 34.

The construction of tray 20 can be best understood by referring to the blank 80 shown in FIG. 1 which is folded as shown in FIGS. 2 and 3 to form the tray. Upright side walls 35 are formed by folding panels 34 along crease lines 70 to become perpendicular with respect to bottom wall 22. Panels 34 have flaps 32 hingedly connected to opposing edges thereof. Flaps 32 may be folded 90° along crease line 68 as shown in FIG. 2.

End walls 50 comprise rectangular panels 24 and 26 which are folded along crease line 62 to be in back-to-back relation with one another. Corner ledge wings 28 are hingedly connected to panel 26 at crease line 64.

Flaps 30 are connected to corner ledge wings 28 through two crease lines 54 and 56. Crease line 54 is parallel with the edge of wing 28. Crease line 56 is formed at an acute angle with respect to crease line 54 as will be explained in detail below.

As shown in FIG. 3 panel 24 is folded 90° with respect to bottom wall 22. Flap 30 is folded along crease lines 54 and 56 180° so that it is in back-to-back relation with corner ledge wing 28. Corner ledge wing 28 is also folded 90° with respect to panel 26. Panel 26 may then be folded 180° downward into back-to-back relation with panel 24. Flaps 32 connected to side walls 34 are sandwiched between back-to-back panels 24 and 26. Thus, end panels 50 provide structural support to tray 20 and hold side walls 35 in perpendicular relation to tray bottom 22.

Notches 38 are provided at the interface between tray bottom 22 and end wall panel 24. Tabs 40 are provided on end wall panels 26 to lock into notches 38.

As shown in FIG. 4, the above-described construction results in a tray 20 having corner ledges 52. The tapered shape of corner ledges 52 is shown in detail in FIG. 5. The taper results from the non-parallel relation of crease lines 54 and 56 on which flap 30 is folded with respect to corner ledge wing 28. Ledge 52 provides support to a similar stackable tray which may be stacked on top of tray 20 as shown in FIGS. 9 through 11.

Figure 5:
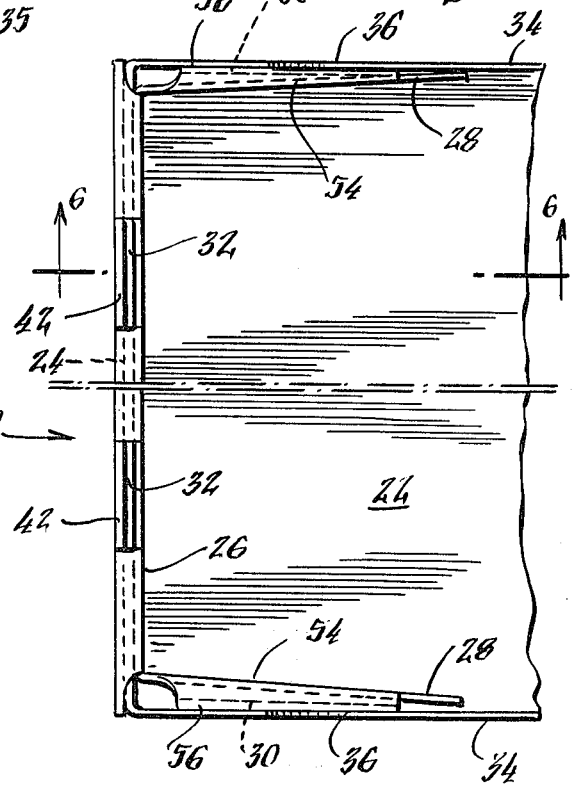
FIG. 5 is an enlarged detail top view of two of the corners of the tray shown in FIG. 4.
Figure 7:
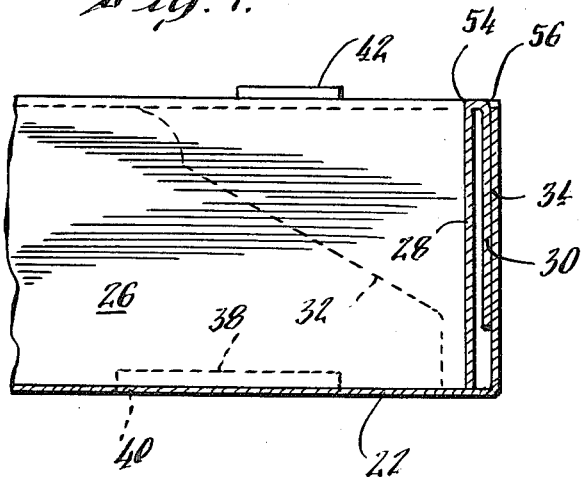
FIG. 7 is a cross-sectional view taken substantially along the plane indicated by line 7—7 of FIG. 6.
Figure 6:
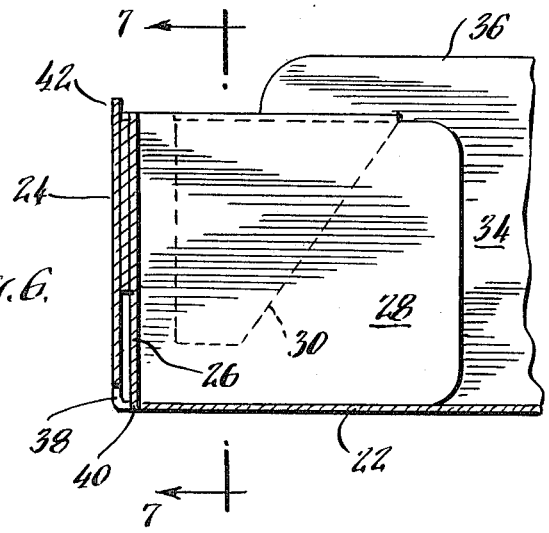
FIG. 6 is a cross-sectional view taken substantially along the plane indicated by line 6—6 of FIG. 5.

The tapered shape of ledge 52 provides a secondary function; namely, padding to provide protection to the contents of the tray against physical damage. A natural tendency of flap 30 to spring out and away from corner ledge wing 28 provides a bias against articles (not shown) that fill tray 20. FIGS. 5 through 7 clearly show the relationship between flap 30, corner ledge wing 28, and side wall panel 34.

As shown in FIG. 1, a three-sided cut is made along tongue 42 which resides within crease line 62. Thus, when panels 26 and 24 are folded into back-to-back relation, tongue 42 protrudes above the top edge of end panel 50 as is more clearly shown in FIGS. 4, 7 and 11. Also shown in FIG. 1 are retaining lips 36 projecting from the top edges of side panels 34. As shown more clearly in FIGS. 4, 9 and 10, retaining lips 36 project above the plane defined by the top edges of end walls 50 and side walls 35.

Tongue members 42 and retaining lips 36 serve to prevent the lateral shifting of a plurality of trays stacked one on top of the other. More particularly, retaining lips 36 prevent the trays from shifting side to side while tongue members 42 prevent them from shifting end to end. It will be recognized by those skilled in the art that tongue members 42 may be placed so as to correspond with notches 38 so that when stacked, the tongue member projecting from the top of a bottom tray will project into a notch 38 present in a top tray. Such a relationship between tongue members 42 and notches 38 results in trays which are easier to stack. This aspect of the preferred embodiment is most clearly shown in FIG. 10.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

What is claimed as new is:

1. A stackable tray for supporting articles comprising:

a pair of opposed side walls each including a retaining lip extending from the top edge thereof;

a pair of opposed end walls connecting said side walls;

each of said side and end walls being foldably connected to a bottom wall for supporting said articles;

each of said end walls including a pair of panels foldably connected to each other in back-to-back relation; and each of the innermost of said end wall panels having a pair of tapered corner ledge wings equal in height to said side walls foldably connected to opposed edges thereof, said corner ledge wings include a flap member of lesser height having a first crease and a second crease at an acute angle with said first crease, said flap member being folded over along said crease and in back-to-back relation with said corner ledge wing to define a tapered ledge even with said top edge and adjacent to its nearest side wall and with the apex of said tapered ledge remote from its connected end wall, thereby providing support in stacking arrangement.

2. The tray of claim 1 wherein each of the innermost of said end wall panels includes at least one downwardly facing tab along its bottom edge received within a notch formed in said bottom wall to lock said side, end, and bottom walls together.

3. The tray of claim 1 wherein each of said end walls includes at least one notch extending along the folded top edge thereof and a corresponding tongue extending upwardly therefrom.

4. An integral paperboard blank for forming a stackable tray comprising:

a first rectangular panel;

a pair of second rectangular panels foldably connected along opposed edges of said first rectangular panel;

a pair of third rectangular panels foldably connected along the remaining opposed edges of said first rectangular panel, said third rectangular panels having fourth rectangular panels foldably connected along the length thereof;

each of said second panels having a pair of opposed substantially triangular flaps foldably connected to the remaining two opposed edges thereof;

each of said fourth panels having a pair of opposed rectangular flaps foldably connected to the two remaining opposed edges thereof;

each of said rectangular flap having a tapered shape ledge foldably connected to one edge thereof and a trapezoidal flap foldably connected to the opposite edge of said tapered shape ledge.

5. The paperboard blank of claim 4 wherein said second rectangular panels each have a substantially rectangular abutment extending therefrom.

6. The paperboard blank of claim 4 or 5 wherein said trapezoidal flaps are joined to said rectangular flaps by first crease lines, said trapezoidal flaps having second crease lines formed at an acute angle with respect to said first crease lines.

* * * * *